US005143285A

United States Patent [19]

Wise

[11] Patent Number: 5,143,285

[45] Date of Patent: Sep. 1, 1992

[54] ILLUMINATED MAILBOX SUPPORT WITH PHOTO-CELL

[76] Inventor: Brian E. Wise, 3959 Warm Spring Rd., Chambersburg, Pa. 17201

[21] Appl. No.: 657,407

[22] Filed: Feb. 19, 1991

[51] Int. Cl.[5] ..... B65D 91/00

[52] U.S. Cl. ..... 232/39; 232/17; 40/566; 40/541

[58] Field of Search ..... 232/39, 38, 17, 34; 40/566, 541, 564, 560, 557; 350/237 R, 214 AL, 239, 211

[56] References Cited

U.S. PATENT DOCUMENTS

| | | | |
|---|---|---|---|
| 1,118,087 | 11/1914 | Wight | 40/557 |
| 1,789,239 | 1/1931 | Landgraf | 40/566 |
| 1,842,597 | 6/1932 | Foti | 40/566 |
| 2,260,082 | 10/1941 | McCauley | 40/564 |
| 3,107,848 | 10/1963 | Penta | 232/17 |
| 3,379,892 | 4/1968 | Neagle | 250/237 R |
| 3,419,726 | 12/1968 | Olsen | 250/237 R |
| 3,521,047 | 7/1970 | Smith | 40/557 |
| 3,843,267 | 10/1974 | Vital | 250/237 R |
| 4,416,414 | 11/1983 | Edgerton | 232/39 |
| 4,848,017 | 7/1989 | Bailey | 40/564 |

*Primary Examiner*—Renee S. Luebke
*Assistant Examiner*—F. Saether
*Attorney, Agent, or Firm*—Leon Gilden

[57] ABSTRACT

A mailbox post is arranged for enhanced illumination visibility, including a central cavity housing an elongate bulb member longitudinally aligned relative to the housing positioned rearwardly of spaced transparent windows configured to direct a message. A photo-cell is mounted exteriorly of the post to effect actuation of the bulb.

1 Claim, 4 Drawing Sheets

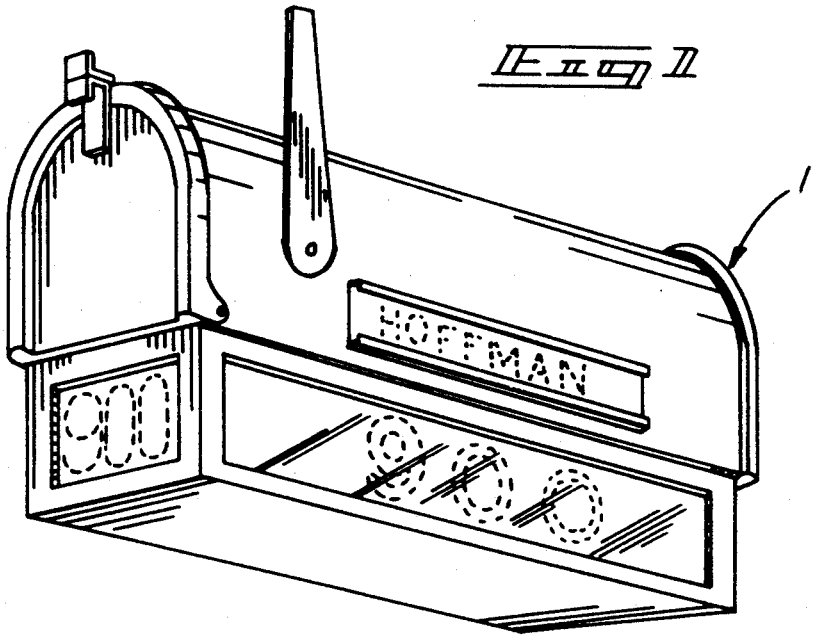
PRIOR ART
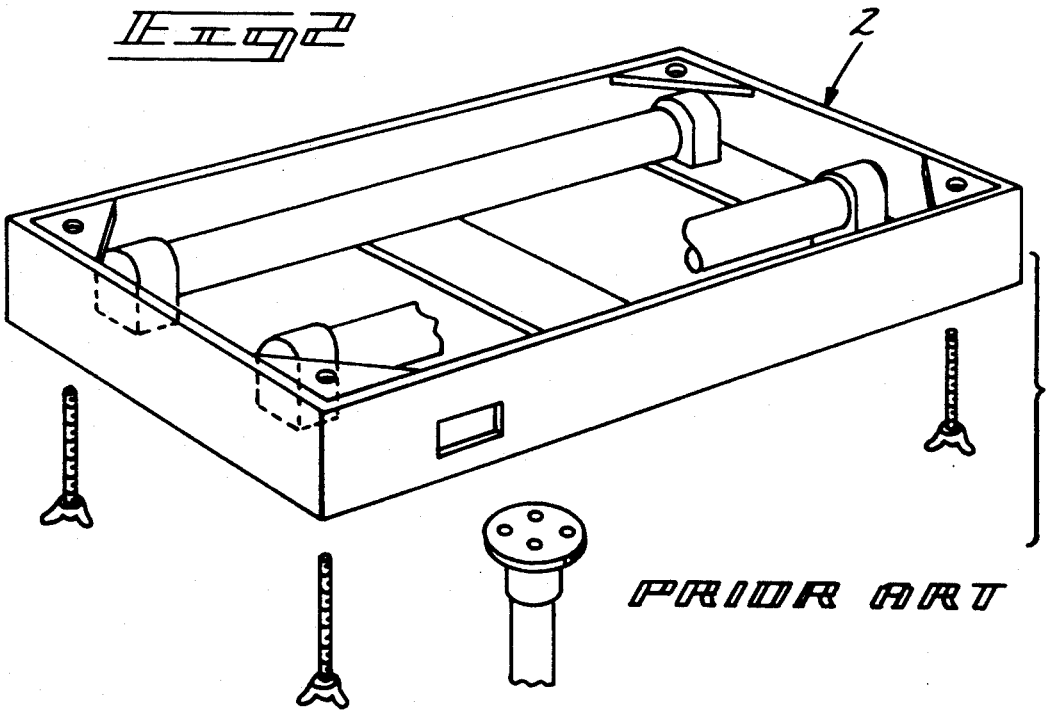
PRIOR ART

ILLUMINATED MAILBOX SUPPORT WITH PHOTO-CELL

BACKGROUND OF THE INVENTION

1. Field of the Invention

The field of invention relates to mailbox apparatus, and more particularly pertains to a new and improved illuminated mailbox post wherein the same is arranged for selective illumination during periods of limited available light.

2. Description of the Prior Art

Various mailbox illumination devices have been utilized in the prior art to provide enhanced visibility of names and addresses and the like associated with mailboxes to ease delivery of mail, as well as direct messages to passersby. Such apparatus may be found for example in U.S. Pat. No. Des. 306,228 to to Hoffman, et al. illustrating a mailbox with an illuminated base.

U.S. Pat. No. 3,275,229 to Turner sets forth various working components of illuminated base for mounting overlying a post and supporting a mailbox thereon.

U.S. Pat. No. 4,089,460 to Mellard sets forth a mailbox wherein deposit of mail therewithin effects telescoping and associated housing and a signal flag to indicate to indicate positioning of mail within a mailbox.

U.S. Pat. No. 1,542,217 to Cole sets forth a further mailbox structure utilizing a signalling device to indicate positioning of mail therewithin.

As such, it may be appreciated that there continues to be a need for a new and improved illuminated mailbox post as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of mailbox apparatus now present in the prior art, the present invention provides an illuminated mailbox post wherein the same utilizes an illumination member mounted within a mailbox post to effect selective illumination within a post directing illumination of a message mounted through the post. As such, the general purpose of the present invention, which will be described subsequently in greater detail, is to provide a new and improved illuminated mailbox post which has all the advantages of the prior art mailbox apparatus and none of the disadvantages.

To attain this, the present invention provides a mailbox post arranged for enhanced illumination visibility, including a central cavity housing an elongate bulb member longitudinally aligned relative to the housing positioned rearwardly of spaced transparent windows configured to direct a message. A photo-cell is mounted exteriorly of the post to effect actuation of the bulb.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved illuminated mailbox post which has all the advantages of the prior art mailbox apparatus and none of the disadvantages.

It is another object of the present invention to provide a new and improved illuminated mailbox post which may be easily and efficiently manufactured and marketed.

It is a further object of the present invention to provide a new and improved illuminated mailbox post which is of a durable and reliable construction.

An even further object of the present invention is to provide a new and improved illuminated mailbox post which is susceptible of a low cost of manufacture with regard to both materials and labor, and which accordingly is then susceptible of low prices of sale to the consuming public, thereby making such illuminated mailbox posts economically available to the buying public.

Still yet another object of the present invention is to provide a new and improved illuminated mailbox post which provides in the apparatuses and methods of the prior art some of the advantages thereof, while simultaneously overcoming some of the disadvantages normally associated therewith.

Still another object of the present invention is to provide a new and improved illuminated mailbox post wherein the same includes an illumination member arranged for selective illumination upon limited available light surrounding a mailbox post to enhance visibility of a message mounted to the post.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art illuminated mailbox apparatus.

FIG. 2 is an isometric illustration of a prior art illuminated base utilized in association with a mailbox.

DESCRIPTION OF THE PREFERRED EMBODIMENT

Figure 3:
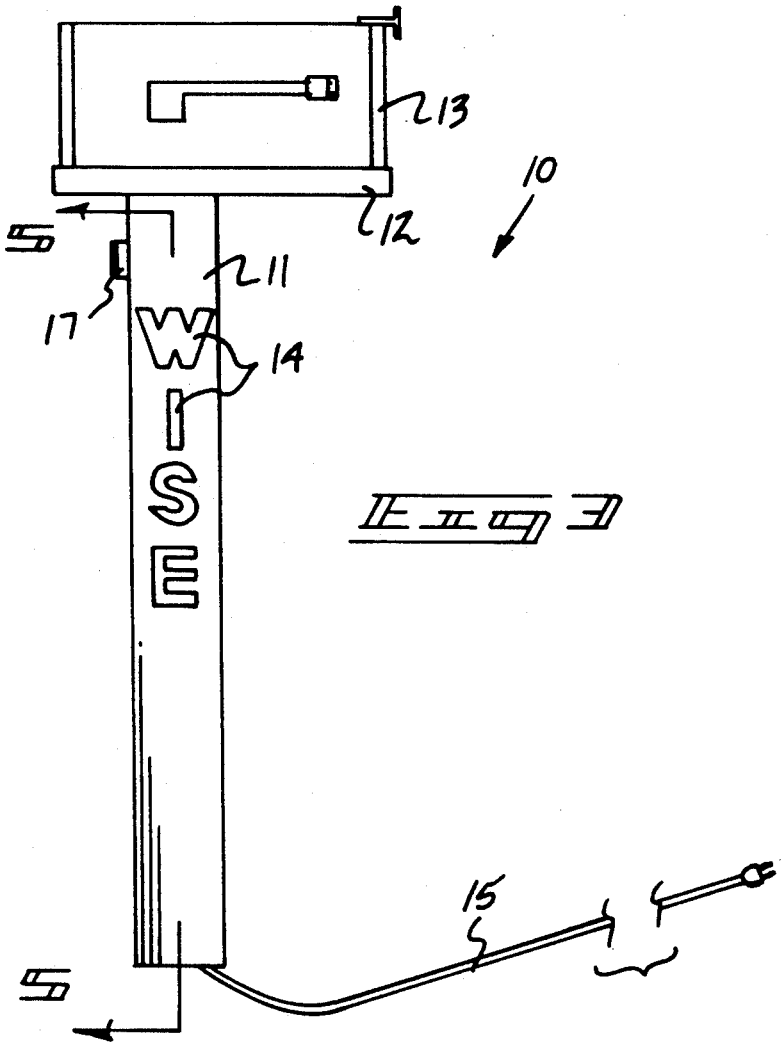
FIG. 3 is an orthographic side view, taken in elevation, of the instant invention.
Figure 4:
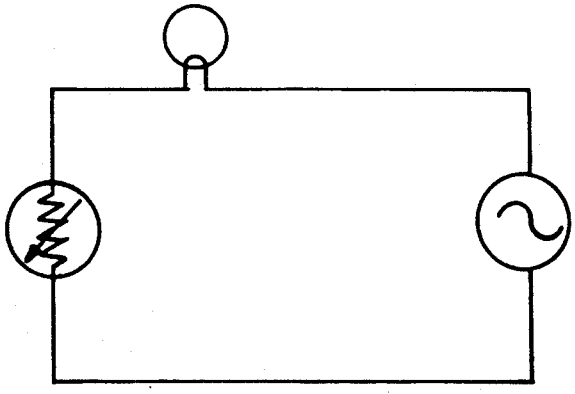
FIG. 4 is a diagrammatic electrical illustration of circuitry utilized by the instant invention.
Figure 5:
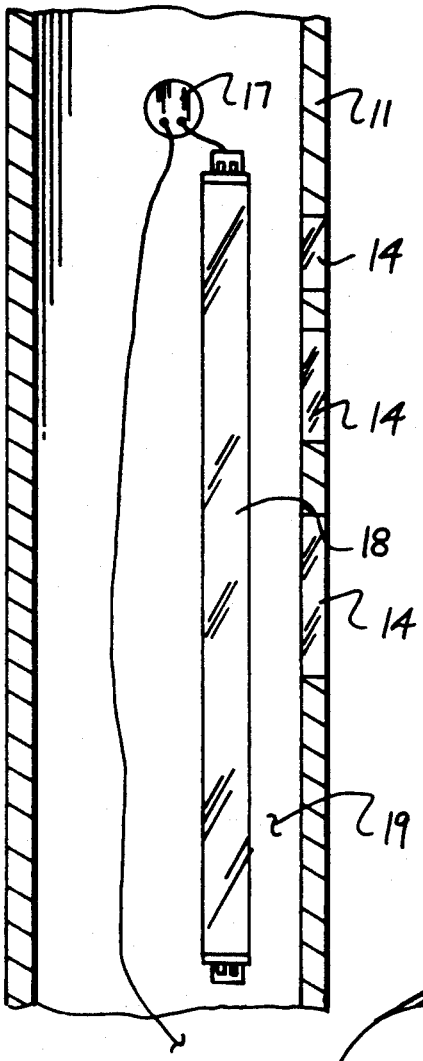
FIG. 5 is a cross-sectional view, taken along the lines 5—5 of FIG. 1 in the direction indicated by the arrows.
Figure 6:
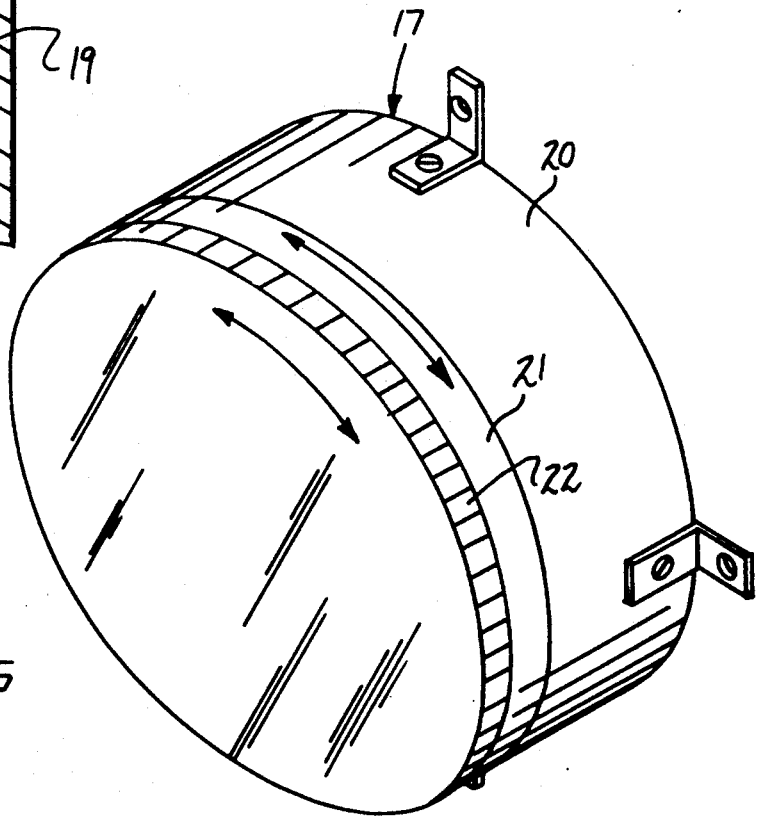
FIG. 6 is an isometric illustration of the photo-cell utilized by the instant invention.

With reference now to the drawings, and in particular to FIGS. 1 to 9 thereof, a new and improved illuminated mailbox post embodying the principles and concepts of the present invention and generally designated by the reference numeral 10 will be described.

FIG. 1 illustrates a prior art mailbox organization 1, as set forth in U.S. Pat. No. Des. 306,228, illustrating an illuminated base. FIG. 2 sets forth an illuminated base structure 2, as presented in U.S. Pat. No. 3,275,229, mounting a plurality of light bulbs therewithin for securement to an upper terminal end of a post.

More specifically, the illuminated mailbox post 10 of the instant invention essentially comprises an elongate longitudinally aligned post 11, with the post 11 including a support plate 12 mounted orthogonally to an upper terminal end of the post 11. A mailbox 13 is mounted to the support plate 13. Directed through the post 11 are a series of spaced transparent windows 14 defining a message. The post 11 includes a post central cavity 19 housing an elongate illumination bulb 18 that extends longitudinally of the post 11 positioned rearwardly and adjacent to the windows 14. Electrical power supply cord 15 directs power from an alternating current source 16 to illumination bulb 18 through a photo-cell switch 17. The photo-cell switch 17 is mounted to an exterior surface of the post 11 to effect illumination of the bulb during conditions of limited available light, such as during dusk and evening hours. To permit adjustment of the photo-cell device to accommodate various light conditions, the photo-cell switch 17 includes a cylindrical photo-cell housing 20 rotatably mounting a respective first and second polarized lens 21 and 22 at a forward terminal end of the housing 20 coaxially aligned therewith. Rotation of the first and second lens 21 and 22 creates a varying effect on light directed therethrough to alter actuation of the illumination bulb 18 depending upon light conditions. To further provide adjustment to the photo-cell switch 17, a photo-cell cover cap 23 is provided formed by a resilient cylindrical sleeve 24 mounting a photochromic lens 25 coaxially thereof at a forward terminal end. The resilient cylindrical sleeve 24 is defined by an internal diameter substantially equal to the external diameter of the housing 20 to permit securement of the sleeve about the housing. The photochromic lens is utilized to accommodate conditions when available light will vary throughout the day, such as sudden darkening as the sun is directed behind a cloud, rain squalls, and the like.

Figure 7:
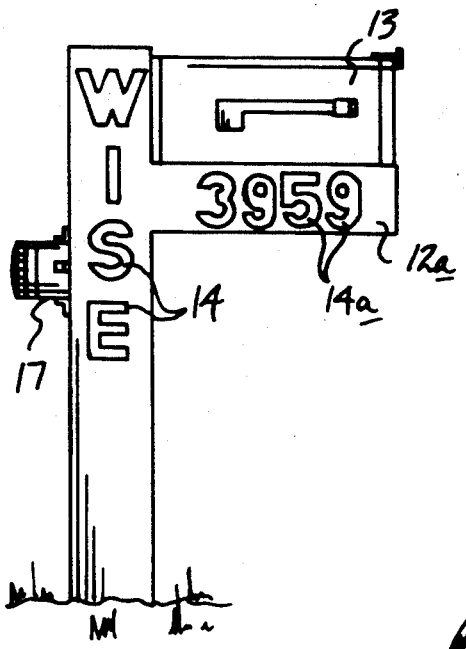
FIG. 7 is an orthographic side view of a modified mailbox post utilized by the instant invention.
Figure 8:
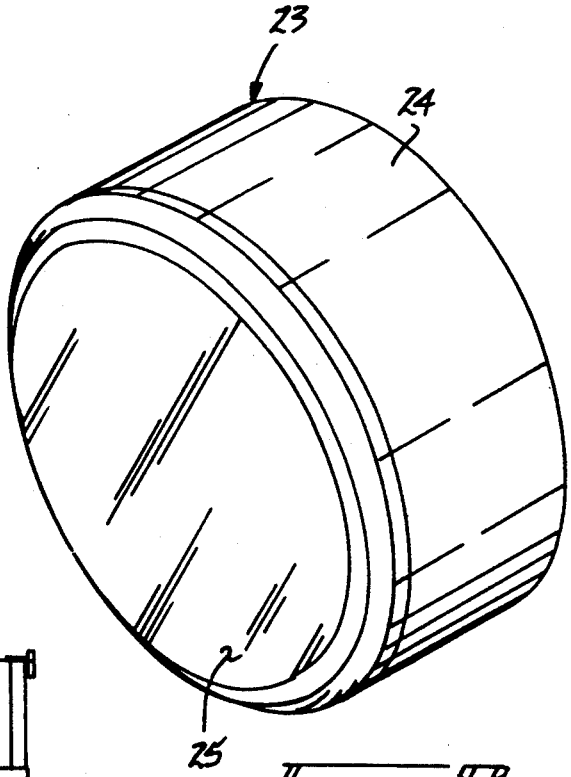
FIG. 8 is an isometric illustration of a photochromic lens cap utilized by the instant invention.
Figure 9:
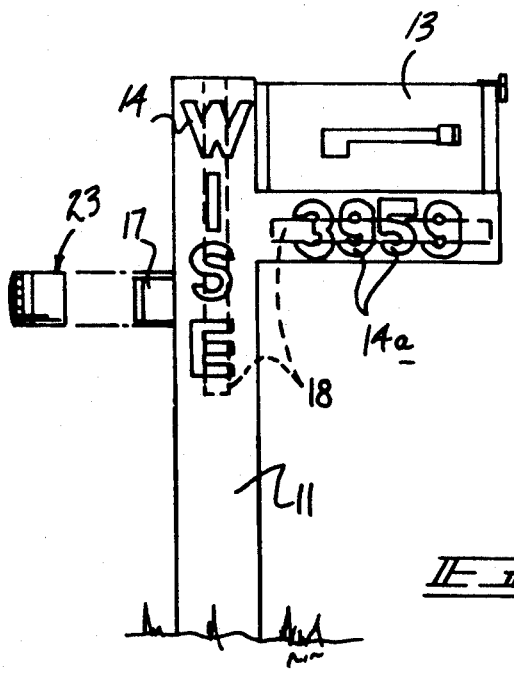
FIG. 9 is an orthographic side view of the photochromic sleeve mounted overlying the photo-cell of the instant invention.

FIGS. 7 and 9 illustrate a modified post apparatus 10*a*, including a modified support plate 12*a* that projects orthogonally relative to the post 11 mounting a further series of transparent windows to provide a plurality of messages in a convenient orientation relative to the post structure, when accordingly a plurality of illumination bulbs are provided within the post structure rearwardly of each series of message windows 14 and 14*a* respectively.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An illuminated mailbox post comprising, in combination, an elongated longitudinally aligned support post, the support post included an elongated support plate orthogonally mounted to a midpoint of the support post, and the support plate mounting an elongated mailbox member extending therealong for reception of mail therewithin, and the support post including an elongate cavity, and the support post including a plurality of transparent windows defining a messaged directed through the support post, and a first illumination bulb mounted within the cavity, longitudinally aligned with the support post and positioned adjacent the windows, and a photo-cell switch means for effecting selective actuation of the illumination bulb during conditions of limited available light, and the support plate includes an elongate housing with an elongate cavity, the elongate cavity including a second illumination bulb mounted therewithin in electrical communication with the first illumination bulb, and a further plurality of transparent windows positioned within the support plate adjacent the first illumination bulb, and the photo-cell switch means includes a photo-cell housing mounted to the support post to the exterior surface thereof, the photo-cell housing defined by a cylindrical configuration and including a first and second polarized lens rotatably mounted at a forward end of the housing, wherein the first and second lens are rotatably mounted relative to each other and the housing to adjust available light directed interiorly of the housing to actuate the photo-cell switch means, and including a photo-cell cover cap, the cover cap including a resilient cylindrical sleeve, the cylindrical sleeve defined by an internal diameter, and wherein the photo-cell housing is defined by an external diameter wherein the internal diameter is substantially equal to the external diameter to mount the resilient cylindrical sleeve coextensively overlying the housing, and the sleeve including a photochromic lens mounted at a forward terminal end of the sleeve, wherein the photochromic lens is positioned adjacent to and overlying the first and second polarized lens to further adjust available light directed into the photo-cell switch means.

* * * * *